US010202740B2

(12) United States Patent
Stockhaus et al.

(10) Patent No.: US 10,202,740 B2
(45) Date of Patent: Feb. 12, 2019

(54) SYSTEM AND METHODS FOR WITH A FIRST AND A SECOND HAND OPERATED CONTROL, CONTROLLING MOTION ON A WORK TOOL FOR A CONSTRUCTION MACHINE

(71) Applicant: Steelwrist AB, Sollentuna (SE)

(72) Inventors: Stefan Stockhaus, Danderyd (SE); Markus Nilsson, Sollentuna (SE)

(73) Assignee: STEELWRIST AB, Sollentuna (SE)

( * ) Notice: Subject to any disclaimer, the term of this patent is extended or adjusted under 35 U.S.C. 154(b) by 7 days.

(21) Appl. No.: 14/900,180

(22) PCT Filed: Jun. 25, 2014

(86) PCT No.: PCT/SE2014/050782
§ 371 (c)(1),
(2) Date: Dec. 21, 2015

(87) PCT Pub. No.: WO2014/209209
PCT Pub. Date: Dec. 31, 2014

(65) Prior Publication Data

US 2016/0145832 A1 May 26, 2016

(30) Foreign Application Priority Data

Jun. 25, 2013 (SE) ..... 1350766

(51) Int. Cl.
*E02F 9/20* (2006.01)
*E02F 3/36* (2006.01)
(Continued)

(52) U.S. Cl.
CPC ..... *E02F 9/2004* (2013.01); *E02F 3/32* (2013.01); *E02F 3/3677* (2013.01);
(Continued)

(58) Field of Classification Search
CPC ..... E02F 3/3677; E02F 3/3681; E02F 9/265
(Continued)

(56) References Cited

U.S. PATENT DOCUMENTS 5,424,623 A * 6/1995 Allen ..... B25J 9/162 180/324
6,282,453 B1 * 8/2001 Lombardi ..... E02F 3/844 700/63

(Continued)

FOREIGN PATENT DOCUMENTS

JP H05202532 8/1993

OTHER PUBLICATIONS

International Search Report for corresponding International application No. PCT/SE2014/050782 dated Sep. 17, 2014.

*Primary Examiner* — Ronald P Jarrett
(74) *Attorney, Agent, or Firm* — Renner Otto Boisselle and Sklar

(57) ABSTRACT

The invention relates to a system and a method for, with a first and a second hand operated control means (11*a*, 11*b*), controlling movement on a work tool (5) for a construction machine (1). The construction machine (1) comprises a lower carriage (2), a top (3), a digging arm (4) and a work tool (5). The digging arm (4) comprises an inner link arm (4*a*) with a first and a second inner link arm end (4*a*1, 4*a*2) and an outer link arm (4*b*) with a first and a second outer link arm end (4*b*1, 4*b*2). The work tool (5) is secured in the second outer link arm end (4*b*2) via an attachment device (6) which enables controlled rotation and controlled tilting of the work tool (5) in relation to the outer link arm (4*b*). The system is characterized in that the first hand operated control means (11*a*) is intended to control the position of the second outer link arm end (4*b*2) and the second hand operated control means (11*b*) is intended to control the function of the
(Continued)

Figure 1:
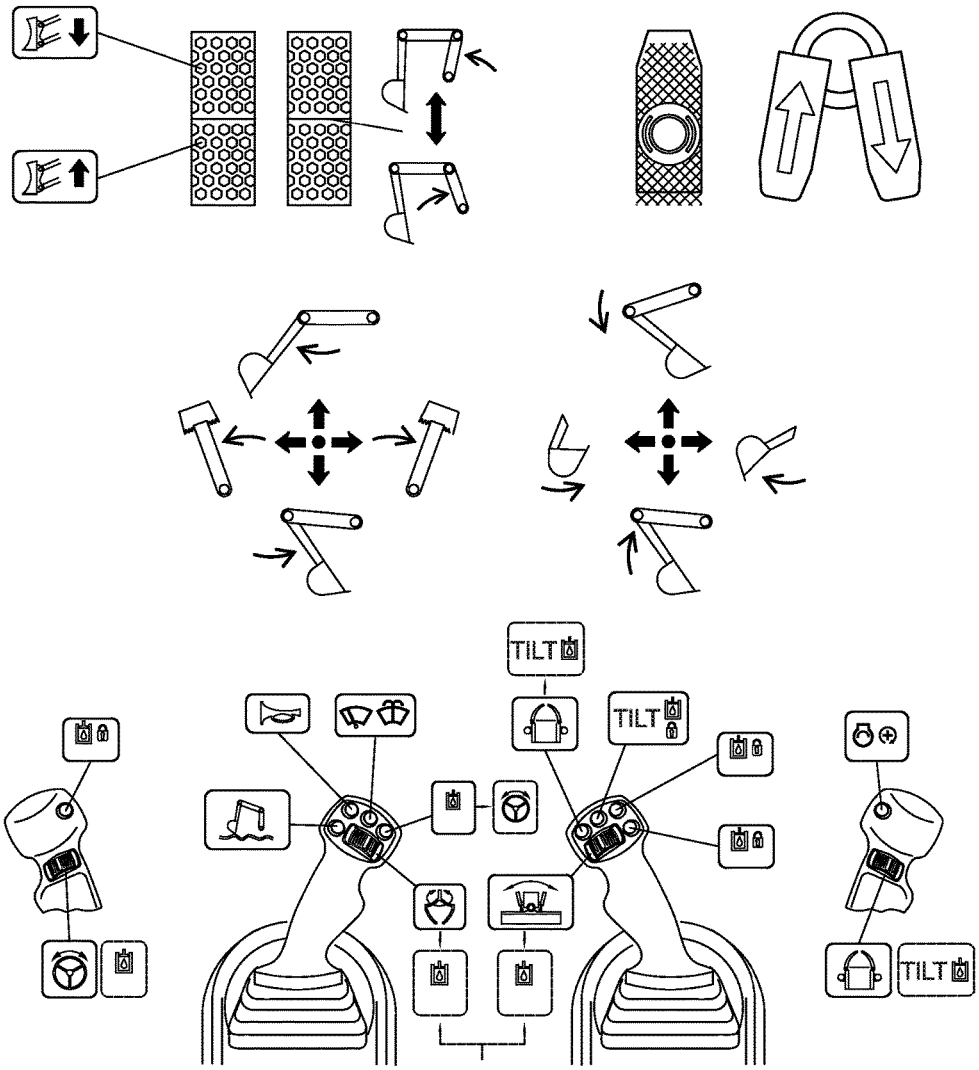

tool (5), comprising controlled rotation and controlled tilting of the work tool (5) in relation to the outer link arm (4*b*).

14 Claims, 3 Drawing Sheets

(51) Int. Cl.
*E02F 3/43* (2006.01)
*E02F 9/26* (2006.01)
*E02F 3/32* (2006.01)

(52) U.S. Cl.
CPC ..... *E02F 3/3681* (2013.01); *E02F 3/435* (2013.01); *E02F 3/437* (2013.01); *E02F 9/265* (2013.01)

(58) Field of Classification Search
USPC ..... 414/694
See application file for complete search history.

(56) References Cited

U.S. PATENT DOCUMENTS

| | | | | |
|---|---|---|---|---|
| 6,481,950 | B1 | 11/2002 | Stickney et al. | |
| 7,458,432 | B2 * | 12/2008 | Mayer | A01D 34/68 180/6.32 |
| 7,681,686 | B1 | 3/2010 | Klas et al. | |
| 2002/0084135 | A1 | 7/2002 | Heyne et al. | |
| 2005/0138850 | A1 | 6/2005 | Brickner et al. | |
| 2008/0127529 | A1 * | 6/2008 | Stanek | E02F 3/435 37/348 |
| 2009/0158625 | A1 | 6/2009 | Pope et al. | |
| 2011/0264336 | A1 * | 10/2011 | Bengtsson | E02F 3/3677 701/50 |
| 2013/0054097 | A1 * | 2/2013 | Montgomery | E02F 9/245 701/50 |
| 2015/0039189 | A1 * | 2/2015 | Wu | E02F 3/436 701/50 |

* cited by examiner

Prior Art

SYSTEM AND METHODS FOR WITH A FIRST AND A SECOND HAND OPERATED CONTROL, CONTROLLING MOTION ON A WORK TOOL FOR A CONSTRUCTION MACHINE

This application is a national phase of International Application No. PCT/SE2014/050782 filed Jun. 25, 2014 and published in the English language, which claims priority to Application No. SE 1350766-0 filed Jun. 25, 2013.

TECHNICAL FIELD

The present invention relates to a system and a method for, with a first and a second hand operated control means, controlling movement on a work tool for a construction machine.

BACKGROUND

The digging performed with a construction machine is performed with an excavation unit made from two fixed link arms, boom and shaft respectively, as well as a work tool in the form of e.g. a bucket. Until the start of the 1960's, excavation units were maneuvered with steel wires and winches that would pull up the bucket, so called [bucket wheels].

Today, construction machines such as excavators, are controlled via joysticks in such a way that every input in a joystick controls a specific hydraulic valve. Each hydraulic valve then controls a certain cylinder or engine, which in turn controls the movement in a certain direction on the arm of the excavator (see FIG. 1), as the previous machines were controlled with wires and winches. In order to perform a specific operation, several joints need to be controlled simultaneously why a number of inputs need to be done at the same time. This means that the driver himself coordinates various movements to get the tip and the tool to a desired position.

In order to bring the bucket straight forward in a horizontal movement at the same time as the bucket is opened, multiple coordinated movements on the joystick are needed. These coordinated movements may be a forward movement on the right joystick, a forward movement on the left joystick as well as a right movement on the right joystick. These three movements must be made simultaneously and in such a way that none of the three valves opens too much or too little, which would mean that it becomes an "unbalanced movement".

This is not a natural and intuitive way of working, and makes the drivers productivity lower and the learning curve longer than it would need to be.

In order to control the movements of the work tool, there is also used separate rolls and buttons arranged in the handle of the joystick. The movement of the rolls and the push of the buttons also control a certain hydraulic valve that controls the movement in a certain direction or a certain function of the work tool. These movements or functions may for example be a rotation or a discharge movement. This gives yet another control parameter to be handled simultaneously, which complicates the work of the driver.

More recently, for the forest industry, there has been introduced a method for crane tip controlling. Crane tip controlling means that the tip of the crane is controlled by a single lever or other control. When the lever is moved forward, the tip of the crane moves in a rectilinear movement forward in the horizontal plane. If the control is moved to the left, the tip of the crane moves to the left, etc. A new control system then controls which valves that need to be activated in order to achieve the desired movement.

A forest machine, however, works in a completely different way than a construction machine. In the tip of the crane in the forest machine, there is provided a harvesting unit which is completely free hanging from the tip of the crane. The freely hanging unit enables the head to follow and intercept a falling tree without any major forces other than tractor forces need to be absorbed by the lift arm. Without a free hanging unit, the crane risks being subjected to such large torque caused by the falling tree that the machine may break.

In a construction machine, such as an excavator or a backhoe loader, the work tool must be turned with force in order to perform digging and excavation work. Thus, the work tool is fixed at the outer tip of the digging arm via an attachment device that enables both controlled rotation as well as tilting of the tool.

A suitable such attachment device is a tiltrotator, which may be likened to the wrist of the excavator arm.

Since the work tool, when employing crane tip controlling on forest machinery, is hanging loosely, there is no way of controlling the exact location, rotation and position of the tool relative to the tip of the crane.

SUMMARY OF THE INVENTION

An object of the present invention is therefore to provide a system and a method for more intuitive control of both the digging arm of a construction machine and the movement of a work tool in an integrated way.

Another object is the provided a system and a method that makes it possible to adjust the velocity in the movement based on the desired task.

The invention thus relates to a system for, with a first and a second hand operated control means, controlling movement on a work tool for a construction machine. The construction machine comprises a lower carriage, a top, a digging arm and a work tool. The digging arm comprises an inner link arm with a first and a second inner link arm end and an outer link arm with a first and a second outer link arm end. One joint connects the top with the first inner link arm end, one joint connects the second inner link arm end with the first outer link arm end and one joint connects the second outer link arm end with the work tool. The work tool is secured in the second outer link arm end via an attachment device that enables controlled rotation and controlled tilting of the work tool in relation to the outer link arm. The system is characterized in that the first hand operated control means is intended to control the position of the second outer link arm end and the second hand operated control means is intended to control the function of the tool.

Through the above system, control of the movement of the tool of the construction machinery is facilitated. The system is intuitive and simple for the driver to learn. Additionally, it is possible to control both rotation and tilting of the tool with the attachment device.

According to one aspect, actuators are provided to, via control devices, control the relative movement between the attachment device and the outer link arm, the outer link arm and the inner link arm, as well as between the inner link arm and the top.

The actuators that are provided may for example be single or double acting hydraulic cylinders, linear motors, screw lines or other devices that may create a relative movement between two parts connected with a joint. If hydraulic cylinders and hydraulic fluid is used, the control devices may be for example hydraulic valves. It is also possible to, as control devices, use electrical servos or other devices in order to, with power supply or otherwise, control the actuators.

According to another aspect, the system comprises a control system which converts the movements of the first and the second control means to signals that activate, deactivate and control the control devices that control the movements of the first and the second link arm, as well as the control devices provided in the attachment device that control the movement of the work tool.

According to another aspect, the control system is arranged to control the velocity of the relative movement between the different moving parts, by via the control devices controlling at least one of power supply, pressure or flow in the different actuators and to the attachment device.

According to another aspect, the attachment device is a tiltrotator and comprises a rotor member intended to control the rotation of the work tool about a first attachment device axis as well as tilting device intended to control the tilt of the work tool about a second attachment device axis substantially perpendicular to the first attachment axis.

According to another aspect, at least one sensor is provided in the attachment device which measures the relative position between the separate parts of the attachment device and/or the force acting on the control devices that are provided connected with the attachment device.

The force acting on the control devices is created by, for example, an increased hydraulic pressure or an increased resistance in the movement between the parts.

According to one aspect, the first and the second control means are possible to tilt in a movement parallel with at least a first and a second control means axis which are substantially perpendicular to each other, and rotate about a third control means axis that is substantially perpendicular to the first and the second control means axis.

According to one aspect, the first and the second control is possible to adjust in height along the vertical control means axis.

According to one aspect, a movement on the first control means is intended to control a movement for the second outer link arm end and where a movement on the second control means is intended to control a movement or a function of the tool.

According to one aspect, the first and the second control means is a touch screen.

The invention also relates to a method for, with a first and a second hand operated control means, controlling a movement on a work tool of a construction machine, wherein the construction machine comprises a bottom carriage, a top, a digging arm and a work tool. The digging arm comprises an inner link arm with a first and a second inner link arm end and an outer link arm with a first and a second outer link arm end. One joint connects the top with the first inner link arm end, one joint connects the second inner link arm end with the first outer link arm end and one joint connects the second outer link arm end with the work tool. The work tool is attached in the second outer link arm end via an attachment device that enables controlled rotation and controlled tilting of the work tool relative to the outer link arm. The method is characterized in that it comprises the steps of: with the first hand operated control means control the position of the outer end of the outer link arm and with the second hand operated control means control the function of the tool.

According to another aspect, the method also comprises the step of, with a control system, converting the movements of the first and the second control means into signals that activate, deactivate and control control devices which control the movements of the first and second link arm and the work tool.

The invention also relates to a computer program product stored in a computer readable medium, which when executed on a computer performs the steps according to the above method.

All above aspects or parts of an aspect may be freely combined, as long as the combination is not contradictory.

SHORT DESCRIPTION OF THE DRAWINGS

Figure 2A:
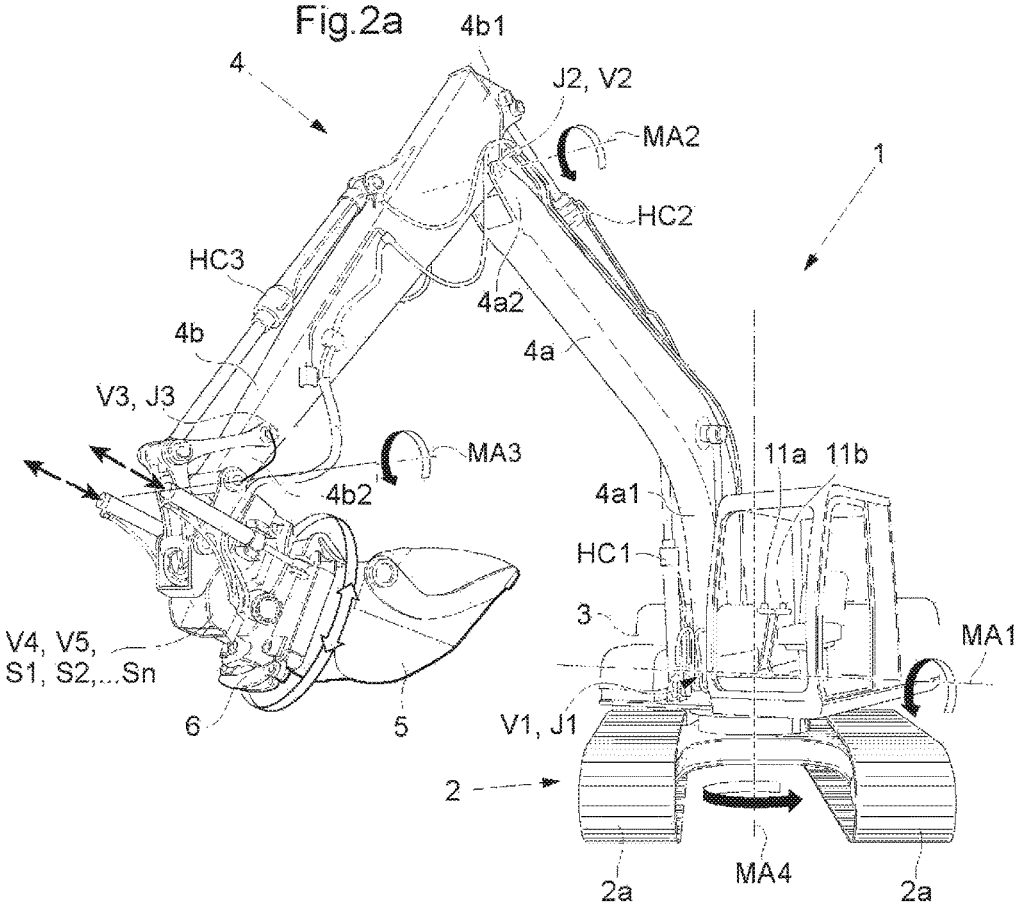
Figure 2B:
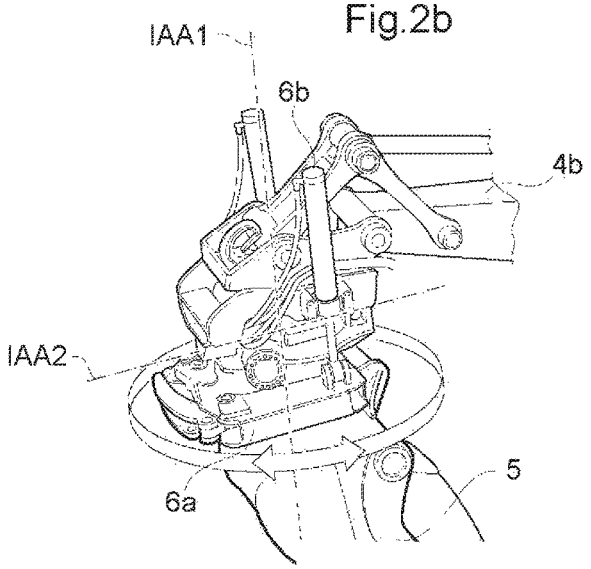
Figure 3A:
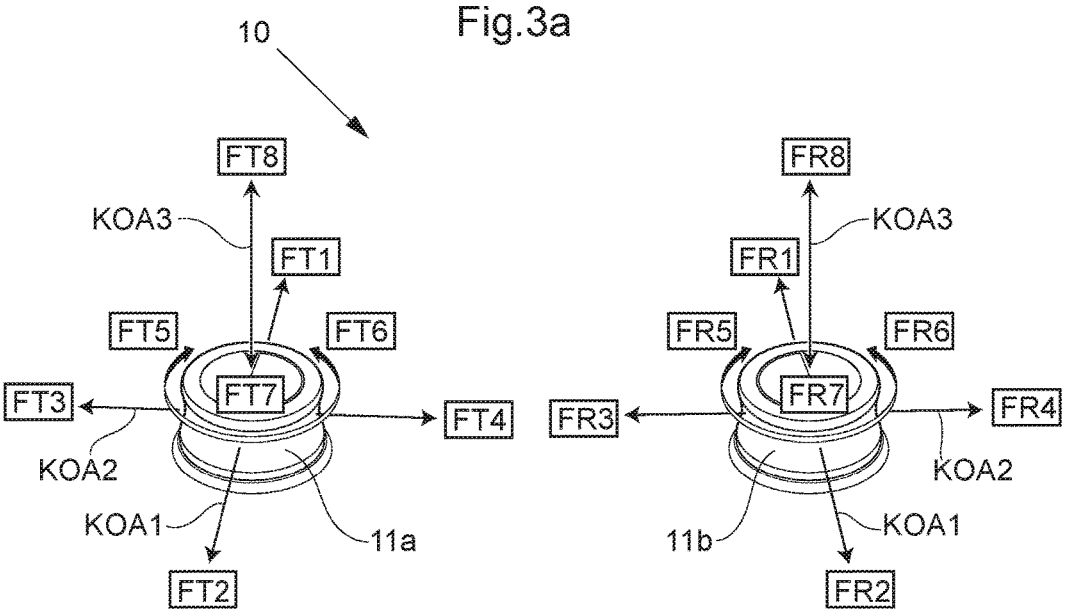

The invention will now be described, by way of example, with reference to the accompanying drawings, in which:

FIG. 1 shows a previously known system for controlling the movements of a work tool FIG. 2*a* shows a construction machine for which the inventive system is suitable FIG. 2*b* shows a detailed view of the construction machine FIG. 3*a* shows the inventive system which controls movement of the work tool.

Figure 3B:
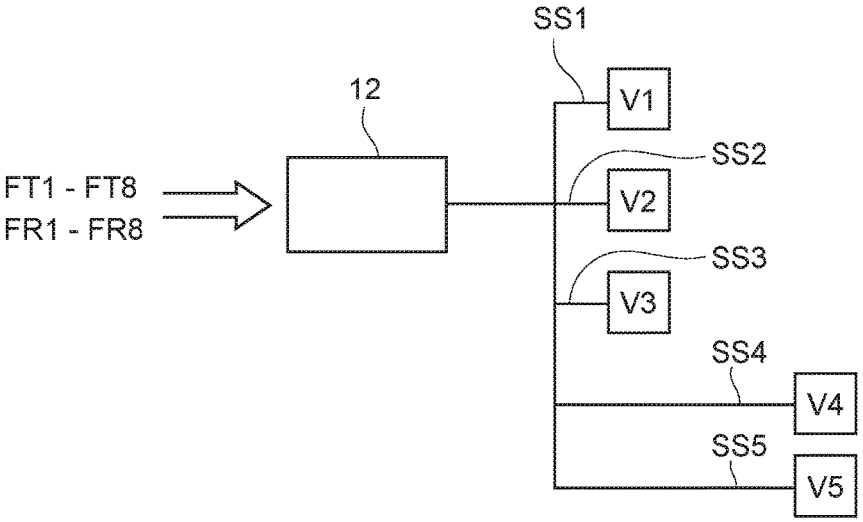

FIG. 3*b* shows a schematic flow of signals from control means via control systems to valves.

DETAILED DESCRIPTION

In the following there is a detailed description of embodiments of the invention. All examples shall be seen as parts of the general description and is therefore generally possible to combine.

In FIG. 2*a* there is shown a construction machine 1 for which the system is suitable. The construction machine 1 comprises preferably a bottom carriage 2 with a driving belt 2*a*, a top 3 as well as a digging arm 4 and a work tool 5. The driving belts 2*a* are of course replaceable with wheels if desired. The digging arm 4 is made up of a at least one inner 4*a* and one outer link arm 4*b*, boom and shaft respectively, where the digging arm is made up of an inner link arm 4*a* with a first and a second inner link arm end 4*a*1, 4*a*2 and an outer link arm 4*b* with a first and a second outer link arm end 4*b*1, 4*b*2. One joint J1 connects the top 3 with the first inner link arm end 4*a*1 and one joint J2 connects the second inner link arm end 4*a*2 with the first outer link arm end 4*b*1. In the outer link arm 4*b* of the digging arm, an attachment device 6 for the work tool 5 is attached via an additional joint J4 that enables a rotation about a third substantially horizontal machine axis MA3 that extends through the joint J3. The attachment device 6 enables controlled rotation and controlled tilting of the tool 5.

All joints J1, J2 are operated by hydraulics and enable a rotation about first, second and third substantially horizontal machine axes MA1, MA2, MA3 which extend through the joints J1, J2, J3. At the respective joint J1, J2, J3 there is arranged at least one actuator HC1, HC2, HC3 which is controlled by control devices V1, V2, V3. In machines of today, one of which is shown in FIG. 1, the actuators are hydraulic cylinders and the control devices are hydraulic valves. The control devices V1, V2, V3 may then be provided in the main block in the machine, and be connected to the hydraulic cylinders via hoses. It is also possible to mount the control devices V1, V2, V3 directly at each joint. If instead electrical signals are used to activate, deactivate and control the control devices which control the actuators, electrical wires may be routed between main block and the respective actuator. It is also possible that the actuators are controlled wirelessly. Each control device V1, V2, V3 controls a certain actuator HC1, HC2, HC3 which in turn controls the movement in a certain direction J1, J2, J3 of the excavator 1.

It is also possible to rotate the whole top 3 of the construction machine in relation to its bottom carriage 2, about a substantially vertical machine axis MA4. Through this rotation the basic position of the work tool 5 in relation to the ground may be set. It is also possible to control the whole basic position of the construction machine in relation to the ground, by controlling direction and velocity of the movement of the belts 2*a* or, if wheels are used, the rotation of the wheels.

The above mentioned attachment device 6 may be a tiltrotator, which is shown further in FIG. 2*b*. The tiltrotator comprises a rotor part 6*a* which makes it possible to, by force, rotate the tool 360 degrees in relation to the outer link arm 4*b* around a first attachment device axis IAA1. The rotation occurs with the help of an actuator that is further controlled by a control device V4 which is arranged in the rotor member 6*a*. The tiltrotator also comprises a tilting device 6*b* which makes it possible to angle the tool in relation to a second control means axis IAA2 substantially perpendicular to the first control means axis IAA1. The second tilting device 6*b* may be another rotor member arranged substantially perpendicular to the first rotor member or one or multiple hydraulic cylinders or other actuators, these also being controlled by control devices V5.

In the attachment device 6 there is also arranged one or multiple sensors S1, S2, . . . Sn which are arranged to sense for example the relative position between the separate parts of the attachment device and the force acting on or the hydraulic pressure in the control devices V4, V5. The sensors may thus sense if and how much the tool is angled. The force that acts on the tool may be read by measuring increased hydraulic pressure or resistance to movement. When the tool encounters rock or similarly for the tool impenetrable material, there is a rapid increase in power in the control devices. When hydraulic cylinders are used as actuators, it is for example possible to strangle the supply of hydraulic fluid to the actuators when a rapid increase in pressure is detected which may prevent a system overload.

The tilt rotator may also be equipped with fast attachments which enable fast and safe changes of work tools 5. The work tool 5 may for example be a bucket, grapple, pallet form, hook, cutter or other suitable tools. It is also possible to integrate a work tool, such as a grapple, in the tiltrotator. Thus the tiltrotator itself may function as a work tool.

FIG. 3*a* shows the inventive system 10 which controls the movement of the work tool. The system 10 comprises a first and a second hand operated control means 11*a*, 11*b*. The control means 11*a*, 11*b* may for example be a joystick or a three-dimensional computer mouse which are possible to rotate about at least a first control means axis KOA1 and to tilt at least in directions parallel with a second and a third control means axis KOA2, KOA3 which are substantially perpendicular to each other and to the first control means axis KOA1. It may also be possible to adjust the first and the second control means vertically along the vertical first control means axis KOA1. Of course it may also be possible to angle the control means 11*b*, 11*b* in every direction that starts from the first control means axis KOA1 and in such a way continuously control the movement on the second end 4*b*2 of the outer link arm.

It is also possible (but not shown) that the control means 11*a*, 11*b* are one or multiple touch screens where the movements of the work tool 5 are controlled by the sweeping movement of one or multiple fingers across the screen.

The first hand operated control means 11*a* is intended to control the position of the second outer link arm end and the second hand operated control means 11*b* is intended to control the function of the tool. With the function of the tool, it is meant for example its rotation and angle in relation to the outer link arm 4*b* and an opening or closing movement on tool 5 or grapple. Preferably the first hand of a driver is used to control the first control means 11*a* and the second hand of a driver to control the second control means 11*b*.

The movements of the first and the second control means 11*a*, 11*b* are converted by a control system 12 into control signals SS1, SS2, SS3, SS4, SS5 which activate, deactivate and control control devices V1-V5 which control the movements of the first and the second link arm 4*a*, 4*b* and the work tool.

The control system 12 controls the control devices V1-V3 so that they convert the movements on the first control means 11*a* to a desired movement on the second outer link arm end 4*b*2 through control of the movements of the first and the second link arm 4*a*, 4*b* relative to each other as well as controls the rotation of the entire digging arm 4 in relation to the top 3.

For example, a tilting of the first control means 11*a* in both directions parallel to the first control means axis KOA1 may bring the tip of the digging arm 4, i.e. the second outer link arm end 4*b*2, away from and towards the driver respectively, function FT1, FT2. A tilting of the first control means 11*a* in both directions parallel to the second control means axis KOA2 may bring the tip of the digging arm 4 to the left and right respectively, function FT3, FT4. This occurs through the entire top 3 including the arm 4 rotating in relation to the bottom carriage 2. A rotation of the first control means 11*a* about the third control means axis KOA3 may rotate the whole construction machine relative to the ground by controlling the digging belts 2*a* or wheels, function FT5, FT6. A dragging and pressing movement, respectively, on the first control means 11*a* direction parallel to the third control means axis KOA3 may bring the tip of the digging arm 4 upwards and downwards respectively, function FT7, FT8.

The control system 12 controls with signals SS4, SS5 also the control devices V4, V5 which are associated with the attachment device 6 so that they convert the movements on the second control means 11*b* to a desired movement and desired function on the attachment device.

For example, a tilting of the second control means 11*b* in both directions parallel to the first control means axis KOA, may close and open the tool 5 respectively, function FR1, FR2. A tilting of the second control means 11*b* in both directions parallel to the second control means axis KOA2 may bring the left and right side, respectively, of the tool down, i.e. rotate about the second attachment device axis IAA2, function FR3, FR4. A rotation of the second control means 11*b* about the third control means axis KOA3 may rotate the tool about the first attachment device axis IAA1, function FR5, FR6. A dragging and pressing movement, respectively, on the second control means 11*b* with direction parallel to the third control means axis KOA3 may for example entail an opening and closing, respectively, of a grapple (if such is mounted at the tiltrotator), function FR7, FR8.

In FIG. 3*b* there is shown a schematic flow of control signals SS1, SS2, SS3, SS4, SS5 created by movements FT1-FT8, FR1-FR8 on the control means 11*a*, 11*b* via the control system 12 to the control devices V1, V2, V3, V4, V5.

The control devices V1-V3 control the movements of the link arm 4*a*, 4*b* relative to each other and controls the rotation of the entire digging arm 4 in relation to the top 3 and the control devices V4, V5 control the relative movements of the attachment device 6. Of course it is possible to arrange more or fewer control devices than mentioned above to control the movements of the digging arm and the tool.

The invention claimed is:

1. A system for, with a first and a second hand operated controller, controlling movement on a work tool for a construction machine, the second controller being separate from the first controller, wherein the first hand of a driver is used to control the first hand operated controller and the second hand of a driver is used to control the second hand operated controller, the construction machine comprising a lower carriage, a top, a digging arm and the work tool, wherein the digging arm comprises an inner link arm with a first and a second inner link arm end and an outer link arm with a first and a second outer link arm end, wherein one joint connects the top with the first inner link arm end, one joint connects the second inner link arm end with the first outer link arm end and one joint connects the second outer link arm end with the work tool, and wherein the work tool is secured in the second outer link arm end via an attachment device which enables controlled rotation and controlled tilting of the work tool in relation to the outer link arm;

wherein the first hand operated controller is configured to control the spatial position of the second outer link arm end, at least through control of the movements of the inner link arm and the outer link arm relative to each other as well as the rotation of the entire digging arm in relation to the top, and through rotation of the entire top including the arm in relation to the lower carriage, and the second hand operated controller is configured to control the function of the work tool, comprising controlled rotation and controlled tilting of the work tool in relation to the outer link arm, wherein the first hand operated controller is configured to control the spatial position of the second outer link arm end by moving the second outer link arm end away from and towards the driver, to the left and to the right, and upwards and downwards.

2. The system according to claim 1, wherein actuators are adapted to, via control devices, control the relative movement between the attachment device and the outer link arm, the outer link arm and the inner link arm and between the inner link arm and the top.

3. The system according to claim 2, comprising a control system which converts the movements of the first and the second controller to signals which activate, deactivate and control the control devices which control the movements of the first and second link arms and which activate, deactivate and control the control devices arranged in the attachment device which control the movement of the work tool.

4. The system according to claim 3, wherein the control system is adapted to control a velocity of the relative movement between the different moveable link arm parts via the control devices controlling at least one of power supply, pressure or flow in the different actuators and to the attachment device.

5. The system according to claim 1, wherein the attachment device is a tiltrotator and comprises a rotor member configured to control the rotation of the work tool about a first attachment device axis and tilting device configured to control the tilting of the work tool about a second attachment device axis substantially perpendicular to the first attachment device axis.

6. The system according to claim 1, wherein at least one sensor is provided in the attachment device which measures at least one of the relative position between the separate parts of the attachment device or the force that acts upon the control devices which are provided interconnected with the attachment device.

7. The system according to claim 1, wherein the first and the second controller are operative to tilt in a movement parallel to at least a first and a second controller axis which are substantially perpendicular to each other and rotate about a third controller axis which is substantially perpendicular to the first and the second controller axis.

8. The system according to claim 7, wherein the first and the second controller is possible to adjust vertically along the third controller axis which is a substantially vertical axis.

9. The system according to claim 1, wherein the first and the second controller is a touch screen.

10. The system according to claim 1, wherein the first hand operated controller is configured to control the spatial position of the second outer link arm end along three different axes of movement.

11. A method for, with a first and a second hand operated controller, the second controller being separate from the first controller, wherein the first hand of a driver is used to control the first hand operated controller and the second hand of a driver is used to control the second hand operated controller, controlling a movement on a work tool for a construction machine, the construction machine comprising a lower carriage, a top, a digging arm and the work tool, wherein the digging arm comprises an inner link arm with a first and a second inner link arm end and an outer link arm with a first and a second outer link arm end, wherein one joint connects the top with the first inner link arm end, one joint connects the second inner link arm end with the first outer link arm end and one joint connects the second outer link arm end with the work tool, and wherein the work tool is secured in the second outer link arm end via an attachment device which enables controlled rotation and controlled tilting of the work tool in relation to the outer link arm;

wherein the method comprises the steps of:

with the first hand operated controller controlling the spatial position of the second outer link arm end, at least through control of the movements of the inner link arm and the outer link arm relative to each other as well as the rotation of the entire digging arm in relation to the top, and through rotation of the entire top including the arm in relation to the lower carriage, and with the second hand operated controller controlling the function of the work tool, comprising controlled rotation and controlled tilting of the work tool in relation to the outer link arm, wherein controlling the spatial position of the second outer link arm end comprises controlling the spatial position of the second outer link arm end by moving the second outer link arm end away from and towards the driver, to the left and to the right, and upwards and downwards.

12. The method according to claim 11 comprising the step of:

with a control system converting the movements of the first and the second controller into control signals which activate, deactivate and control control devices which control the movements of the first and the second link arm and the work tool.

13. The method according to claim 11, wherein controlling the spatial position of the second outer link arm end comprises controlling the spatial position of the second outer link arm end over three different axes of movement.

14. A computer program product stored on a non-transitory computer readable medium for controlling a movement on a work tool for a construction machine having a first and a second hand operated controller, the second controller being separate from the first controller, wherein the first hand of a driver is used to control the first hand operated controller and the second hand of a driver is used to control the second hand operated controller, the construction machine comprising a lower carriage, a top, a digging arm and the work tool, wherein the digging arm comprises an inner link arm with a first and a second inner link arm end and an outer link arm with a first and a second outer link arm end, wherein one joint connects the top with the first inner link arm end, one joint connects the second inner link arm end with the first outer link arm end and one joint connects the second outer link arm end with the work tool, and wherein the work tool is secured in the second outer link arm end via an attachment device which enables controlled rotation and controlled tilting of the work tool in relation to the outer link arm, wherein when executed on a computer causes the computer to control rotation and control tilting of the work tool in relation to the outer link arm with the first hand operated controller controlling the spatial position of the second outer link arm end, at least through control of the movements of the inner link arm and the outer link arm relative to each other as well as the rotation of the entire digging arm in relation to the top, and through rotation of the entire top including the arm in relation to the lower carriage, and with the second hand operated controller controlling the function of the tool, wherein controlling the spatial position of the second outer link arm end comprises controlling the spatial position of the second outer link arm end by moving the second outer link arm end away from and towards the driver, to the left and to the right, and upwards and downwards.

* * * * *